US005946784A

United States Patent [19]

Komsta et al.

[11] Patent Number: 5,946,784

[45] Date of Patent: Sep. 7, 1999

[54] JAM CLEARANCE ADAPTOR FOR RIVET SETTING TOOL

[75] Inventors: Theodore S. Komsta, Bridgeport; Donald J. Donofrio, III, New Haven, both of Conn.

[73] Assignee: Emhart Inc., Newark, Del.

[21] Appl. No.: 08/993,164

[22] Filed: Dec. 18, 1997

[51] Int. Cl.[6] ..... B21J 15/28

[52] U.S. Cl. ..... 29/243.523; 29/243.525

[58] Field of Search ..... 72/391.6; 29/243.521, 29/243.523, 243.524, 243.525

[56] References Cited

U.S. PATENT DOCUMENTS 3,367,166 2/1968 Newton et al. ..... 29/243.523
4,130,006 12/1978 Ebbert et al. .
4,275,582 6/1981 Sheffield et al. .
4,454,746 6/1984 Schwab ..... 72/391.6
4,577,794 3/1986 Armstrong et al. .
5,035,353 7/1991 Smart et al. ..... 29/243.525
5,357,666 10/1994 El Dessouky et al. .
5,697,136 12/1997 Frearson et al. ..... 29/243.523

*Primary Examiner*—David Jones
*Attorney, Agent, or Firm*—Edward D. Murphy

[57] ABSTRACT

The mandrel jamming area in a power-operated blind rivet tool is allowed to separate into sections under conditions in which mandrel jamming occurs, so that the jammed mandrels can be easily cleared from the area and the sections then rejoined for normal operation.

10 Claims, 2 Drawing Sheets

JAM CLEARANCE ADAPTOR FOR RIVET SETTING TOOL

BACKGROUND OF THE INVENTION

This invention relates to blind rivet setting tools and particularly to an apparatus for addressing the problem of rivet mandrel jamming in such tools.

Rivet tools of this kind generally operate from a pressurized air supply that is controlled by a trigger lever. When the lever is operated pressurized air pushes an air piston which in turn acts on a hydraulic ram assembly that forces hydraulic fluid from a reservoir in the handle of the tool into a main hydraulic bore where it moves a hydraulic piston with an attached rivet pulling mechanism rearward. As the pulling mechanism with its pulling jaws move rearwardly the jaws close on and grip the rivet mandrel and set the rivet. When the trigger is released, the hydraulic piston is pushed forward to the starting position so that the hydraulic fluid is also forced back, returning the hydraulic fluid and the air piston to the starting position. When the hydraulic piston is fully returned the broken rivet mandrel is released as the pulling jaws are forced open by acting against the nose piece of the tool. The spent mandrel is then drawn out of the tool through a vacuum passageway and deposited in a mandrel collection container.

The spent mandrels can jam in the passageway on their way to the mandrel container for any number of reasons, including dirt and oil build up in the passageway, a kink in the collection hose, insufficient vacuum due to a leak, a bent mandrel in the mix, or simply the changing shape and direction of the passageway combining at times to defeat mandrel exit, especially in the vicinity of the connection between the exit hose and the tool.

Normally one would shake or twist the collection hose to clear an obstruction and failing that dismantle sections of the tool in order to gain access to the jammed area so as to manually clear the passageway. A known method is described in the patent to Ebbert et al (4,130,006) in which an axially shiftable tube is provided in the tool passageway where it is expected jamming might occur. Reciprocating the tube, it is suggested, will shake the jammed mandrels free. In each case, however, chance as much as management plays a role in freeing the jam, which means that jam clearance is not always achieved in a timely and efficient manner.

OBJECTS AND SUMMARY

It is the primary purpose and principle object of the present invention to provide a device for overcoming the aforementioned problems in a time-saving and low-cost manner, specifically by providing a mandrel-jam freeing device which can be installed as an integral part of any rivet setting tool as generally described above or retrofitted with existing tools.

According to one embodiment of the present invention the mandrel jamming area in a power-operated blind rivet tool, that is, the area where the mandrel exit tube changes shape or direction, is caused to separate into sections so that the jammed mandrels can be easily cleared and the sections then rejoined for normal operation. Specifically, a removable section is provided between the tool housing and the collection hose, which section is pushed off from the tool housing under pressure transmitted through mandrels accumulating in the exit area. The tool can then be easily cleared of the offending mandrels and the section rejoined with the tool housing for return to normal operation.

The invention will be better understood and further objects and advantages thereof will become more apparent from the ensuing detailed description of the preferred embodiments taking in conjunction with the drawing.

DETAILED DESCRIPTION

Figure 1:
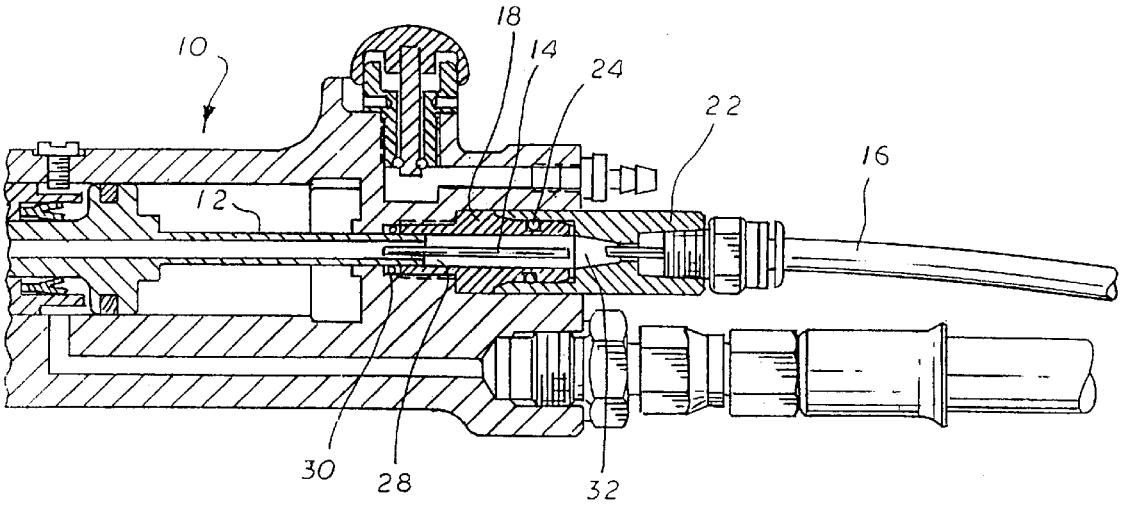
FIG. 1 is a schematic partial section in side elevation of a rivet setting tool using the present invention.
Figure 2:
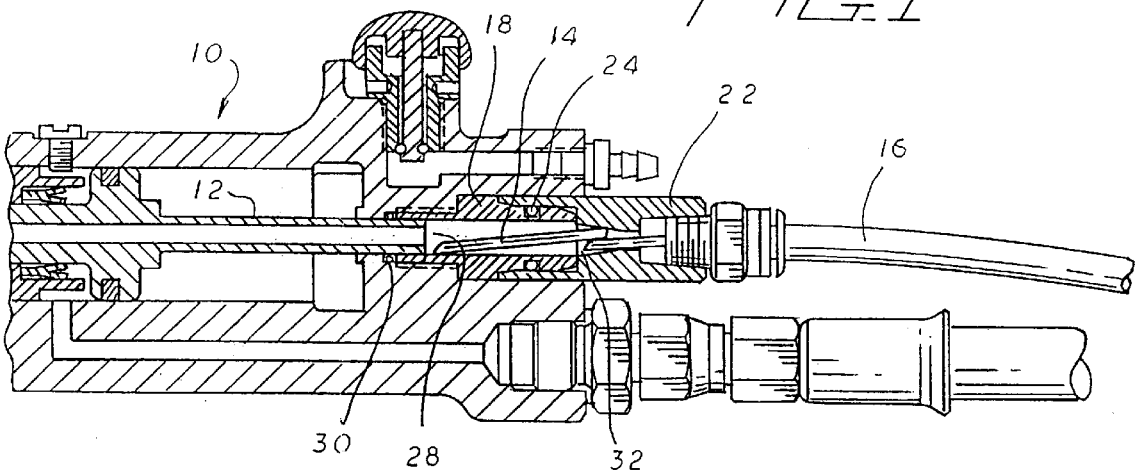
FIG. 2 is a schematic partial section in side elevation of a rivet setting tool using the present invention under conditions in which a mandrel jam is about to occur.
Figure 3:
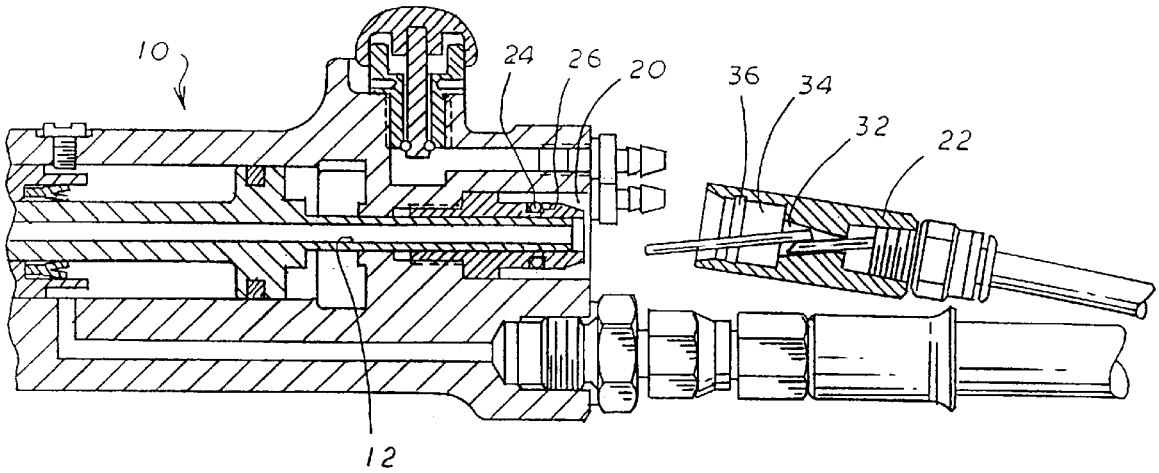
FIG. 3 is a schematic partial section in side elevation of a rivet setting tool using the present invention in which the removable section is seen removed from the tool.

Referring now to FIGS. 1–3 there is shown a housing section 10 of a conventional rivet setting tool, particularly a blind rivet-setting tool, that houses a hydraulically-operated tube or channel 12 for conveying the broken off mandrels 14 to a collection hose 16 and ultimately into a collection container (not shown). The tube 12 is shown to be integral with a a conventionally-operated hydraulic piston, but the piston and its operation forms no part of the present invention. The tube 12 is seen to slide within a channel 28 of a connector member 18 whose exterior threaded surface at one end screws into the tool housing 10, as shown, and whose opposite end is of a reduced diameter and thus defines an annular space 20 between itself and the housing 10 (as best shown in FIG. 3). Fitting into this annular space 20 is a female or socket portion of a hose coupler member 22 that has an inner annular shape complementing the outer annular shape of the extended end of the connector member 18. In order to secure a seal-tight connection between the connector member 18 and the hose coupler member 22, an O-ring 24 is located in an annular groove 26 provided for that purpose in the connector member 18, as shown. The O-ring 24 will stay in place by virtue of a compressive fit in the groove 26 on the connector member 18 and so provides a frictional connection between the connector 18 and coupler 22, a connection which is releasable under certain conditions as will be more fully explained below. A suitable O-ring 30 surrounding the tube 12 provides a further seal between the housing 10 and the connector member 18 (see FIGS. 1 and 2).

The hose coupler member 22 is also seen to have an inner conically shaped channel 32 whose one end is the same diameter as or larger than the inner channel 28 of the connector member 18 which it bears against and whose opposite end defines a smaller diameter as the result of a taper which then communicates with a larger-diameter threaded outlet end of the coupler 22 that is screw-threaded to a suitable connector for the collector hose 16, as shown. The reason for the tape is to direct or channel the mandrels stems 14 to the central area of the outlet end of the coupler 22 and hence into the collector hose 16. Extending from the larger diameter end of the channel 32 (see FIG. 3) is an annular section 34 having an annular groove 36 which mates with the O-ring 24 when the two members, connector 18 and coupler 22, are properly coupled, as shown in FIG. 1.

As shown in FIG. 1 the mandrels 14 are fed in an in-line manner through the tube 12 under the agency of a fluid pressure, particularly a negative air pressure, or in some cases a positive pressure, so that the mandrels enter the connector member 18 and thence into the conically shaped channel 32 of the hose connector 22. It is at this point when the mandrels 14 encounter a change in shape of their outlet path that jamming can occur. As each mandrel enters the diameter shrinking or shape-changing area of the channel 32 it is caused to shift its direction somewhat, so that its quite possible for the mandrels to become skewed with respect to their generally straight-line exit path and thus override one another; that is, the leading end of one mandrel can ride up on the hind end of a preceding mandrel, as shown in FIG. 2, especially in the conically-shaped channel 32 of the hose coupler 22.

According to the principles of the invention this jamming condition will create a force that overcomes the gripping or frictional force of the O-ring 24 between the connector 18 and the coupler 22, so that the latter will eventually be separated from its mooring, that is, from the connector member 18, as best shown in FIG. 3. Specifically, the end portion of the reciprocating tube 12 will bear against a hindmost mandrel of a mandrel jam, as shown about to happen in FIG. 2, and by means of the movement of the tube 12 push the mandrel jam rearwardly and thus overcome the frictional fit between the connector and the coupler members, as previously described. Once these members are separated, the vacuum pressure in tube 12 is lost and the operator of the rivet tool can manually clean out the jammed area of the tool. Restoring the separated members, 18 and 22, to their originally connected condition, that is, with the O-ring 24 assuming again its frictional grip between the parts, will restore as well the vacuum pressure in the system, and the rivet setting cycle can then continue without having to replace any damaged parts.

It will be appreciated that the degree of friction or force that needs to be overcome in order for the connector member 18 and the coupler member 22 to separate is directly dependent upon the physical properties of the O-ring 24, that is, its degree of resiliency, plasticity and elasticity, which in turn will depend upon not so much the material used in such O-rings—normally an elastomer or rubber compound—but on the the size or dimension of the O-ring. The larger the size of the O-ring, that is, the thickness or diameter of its circular peripheral component (and not the diameter of its hole size, which should be only a little less than the diameter of the annular groove 26 in which the O-ring 24 is stretched to fit), the greater the frictional force exerted by the O-ring between the juxtaposed surfaces of the connector and the coupler members. By experimenting with different sized O-rings a suitable friction force can be arrived at for both holding the connector-coupler assembly together and for allowing it to disassemble or separate after sufficient force builds up from the occurrence of a mandrel jam in the channel areas above described.

Figure 4:
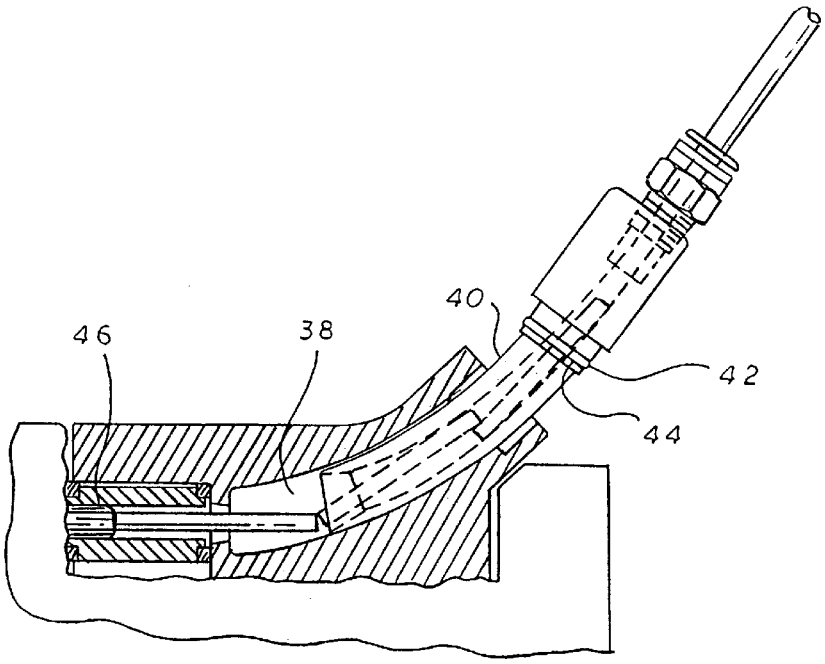
FIG. 4 is a schematic partial section in side elevation of a rivet setting tool with a curved mandrel exit passageway using the present invention under conditions in which a mandrel jam has occurred and the removable section is about to be removed from the tool.

FIG. 4 shows a further embodiment in which the rivet tool is equipped with a curved mandrel-exit passageway 38 that incorporates a curved coupler member 40, shown partially in dotted lines and having a O-ring 42 positioned thereon within a suitable groove 44. Towards the exit end of the curved passageway 38 there may be a slightly enlarged portion, as shown, that frictionally receives the O-ring 42 positioned on the coupler member 40. The opposite end of the coupler member 40, when held in the passageway 38 by the frictional fit of the O-ring 42, is positioned adjacent a channel that receives a slidable tube 46 (similar to tube 12) for conveying the broken off mandrels. As shown, the coupler member 40 has been pushed by the jammed mandrels part way out of the passageway 38, that is, popped off (or pushed out) from its frictional O-ring fit within the enlarged portion of the passageway 38. To clear away the jammed mandrels, all that is necessary is to pull the collector hose and hence the coupler 40 attached thereto completely free from the passageway 38, remove the offending mandrels from the passageway and recouple the separated sections or parts so that the O-ring seal 42 is once more positioned in the passageway 38 where it both seals and frictionally grips the connection between the parts.

It should be understood that the connector 18 and coupler 22 form an assembly or unit when connected together in the manner above described and can be retro-fitted as a unit to existing rivet tools, with or without the intervention of an intermediate coupler member between hose and tool. The connector-coupler assembly of the present invention would then be screw-threaded into place in the tool, and the collector hose could then be screw threaded into the connector-coupler unit, replacing whatever conventional connector member was previously used.

The foregoing relates to preferred exemplary embodiments and examples of the present invention, it being understood that other embodiments and variants thereof are possible within the scope of the invention, the latter being defined by the appended claims.

What is claimed and desired to be secured by Letters Patent of the United States is:

1. A jam clearance adaptor for a blind rivet tool in which a hydraulically-operated tube member is slidable within said tool and conveys under a fluid agency broken-off mandrel stems to a collector hose, the combination comprising a connector member releasably fitted to said tool and having a channel therein for receiving said slidable tube member, a coupler member having a channel therein and having one end connected to said collector hose, said coupler member further having a socket portion at the other end thereof, said connector member having an extended end portion thereof for receiving said socket portion of said coupler member, whereby said channel of said connector member and said channel of said coupler member are juxtaposed and coaxial with respect to one another, and a resilient sealing means disposed between said extended end portion of said connector member and said socket portion of said coupler member, providing thereby a frictional grip between said members and allowing the continuous flow of said broken off mandrel stems through said channels of said members but further allowing release of said members one from the other when forced by a mandrel jam occurring in said channels.

2. A jam clearance adaptor according to claim 1, wherein said resilient sealing means is an O-ring.

3. A jam clearance adaptor according to claim 1, wherein said extended end portion of said connector member is complementary in shape to the inner annular shape of said socket portion of said coupler member.

4. A jam clearance adaptor according to claim 2, wherein said O-ring is disposed within an annular groove in said extended end portion of said connected member member and an annular groove in the the inner annular surface of said socket portion of said coupler member.

5. A jam clearance adaptor according to claim 1, wherein said connector member is screw-threaded to said tool.

6. A jam clearance adaptor for a blind rivet tool in which a hydraulically-operated tube member is slidable within said tool and conveys under a fluid agency broken-off mandrel stems to a collector hose, the combination comprising a curved passageway having one end abutting a channel in said tool that slidably receives said tube, said curved passageway having an opposite open end exiting from said tool, a curved coupler member having a curved channel therein and slidably fitting in said passageway and having one end connected to said collector hose, and a resilient sealing means disposed between said curved passageway and said curved coupler member, providing thereby a frictional grip between said passageway and said coupler member for retaining said coupler member in said passageway and allowing the continuous flow of said broken off mandrel stems through said curved channel of said coupler member but further allowing release of said coupler member from said passageway when forced by a mandrel jam occurring in said passageway.

7. A jam clearance adaptor according to claim 6, wherein said resilient sealing means is an O-ring.

8. A jam clearance adaptor for a blind rivet tool in which a hydraulically-operated tube member is slidable within said tool and conveys under a fluid agency broken-off mandrel stems to a collector hose, the combination comprising a connector-coupler assembly fitted to said tool and having an articulated channel therein for receiving said slidable tube member and said broken-off mandrel stems, and a resilient sealing means disposed within said connector-coupler assembly for frictionally holding said assembly together and allowing said broken off mandrel stems to continuously flow through said assembly but further allowing said assembly to separate when a mandrel jam occurs within said articulated channel, thereby overcoming the frictional strength of said resilient sealing means.

9. A jam clearance adaptor for a blind rivet tool in which a hydraulically-operated tube member is slidable within said tool and conveys under a fluid agency broken-off mandrel stems to a collector hose, the combination comprising a connector-coupler assembly fitted to said tool and having an articulated channel therein for receiving said slidable tube member and said broken-off mandrel stems, a resilient sealing means disposed within said connector-coupler assembly for frictionally holding said assembly together, and said slidable tube member allowing said broken off mandrel stems to continuously flow through said assembly but further causing said assembly to separate when an end portion of said slidable tube pushes against a mandrel jam occurring within said articulated channel in said assembly, thereby overcoming the fictional strength of said resilient sealing means.

10. A method for clearing a mandrel jam in a blind rivet tool in which a hydraulically-operated tube member is slidable within said tool and conveys under a fluid agency broken-off mandrel stems to a collector hose, the steps comprising fitting an articulated connector assembly between said tool and said collector hose for receiving an end portion of said slidable tube member and said broken-off mandrel stems, frictionally holding said connector assembly together, and causing said slidable tube member to push against a mandrel jam when it occurs within said connector assembly to thereby overcome the friction holding said connector assembly together.

* * * * *